US005443374A

United States Patent [19]

Yoshii et al.

[11] Patent Number: 5,443,374

[45] Date of Patent: Aug. 22, 1995

[54] MOTOR DRIVEN FLUID COMPRESSOR

[75] Inventors: Yuji Yoshii, Takasaki; Takayuki Kudo, Isesaki, both of Japan

[73] Assignee: Sanden Corporation, Isesaki, Japan

[21] Appl. No.: 183,781

[22] Filed: Jan. 21, 1994

Related U.S. Application Data

[63] Continuation of Ser. No. 966,397, Oct. 26, 1992, abandoned.

[30] Foreign Application Priority Data

Oct. 24, 1991 [JP] Japan ..... 3-278051

[51] Int. Cl.[6] ..... F01C 1/04

[52] U.S. Cl. ..... 418/55.1; 418/183

[58] Field of Search ..... 418/55.1, 183, 188; 417/902, 423.14

[56] References Cited

U.S. PATENT DOCUMENTS

| | | | |
|---|---|---|---|
| 1,934,155 | 11/1933 | Deventer | 417/410 |
| 2,178,425 | 10/1939 | Johnson | 418/259 |
| 2,331,878 | 10/1943 | Wentworth | 417/410 |
| 3,463,091 | 3/1967 | Delsuc | 418/55 |
| 4,065,279 | 12/1977 | McCullough | 418/55 |
| 4,201,521 | 5/1980 | Carlson | 417/410 |
| 4,466,784 | 8/1984 | Hiraga | 418/55 |
| 4,744,737 | 5/1988 | Yamamura et al. | 418/55.1 |
| 4,900,238 | 2/1990 | Shiemi et al. | 417/410 |
| 4,932,845 | 6/1990 | Kikuchi et al. | 418/188 |
| 4,936,756 | 6/1990 | Shimizu et al. | 418/188 |
| 4,940,396 | 7/1990 | Shimizu et al. | 417/410 |
| 4,958,991 | 9/1990 | Kikuchi | 418/188 |
| 5,090,880 | 2/1992 | Mashimo | 418/55.1 |
| 5,188,520 | 2/1993 | Nakamura et al. | 418/55.1 |

FOREIGN PATENT DOCUMENTS

| | | | |
|---|---|---|---|
| 059925 | 3/1982 | European Pat. Off. . | |
| 1116060 | 10/1961 | Germany | 417/423.14 |
| 0103980 | 6/1984 | Japan | 418/55.1 |
| 0040472 | 2/1986 | Japan | 418/55.1 |
| 61-116089 | 6/1986 | Japan . | |
| 61-226587 | 10/1986 | Japan . | |
| 0268992 | 11/1988 | Japan | 418/55.1 |
| 4076287 | 3/1992 | Japan | 418/55.1 |

*Primary Examiner*—Richard A. Bertsch
*Assistant Examiner*—Charles G. Freay
*Attorney, Agent, or Firm*—Baker & Botts

[57] ABSTRACT

A hermetic type scroll compressor includes a hermetically sealed compressor housing formed by first and second cup-shaped casings. A cylindrical housing portion is disposed between the first and second cup-shaped casings and has an annular inner block extending inwardly therefrom. The inner block divides the interior of the compressor into a first chamber in which the drive mechanism is housed and a second chamber in which the compression mechanism is housed. At one end, the drive shaft is supported by the inner block through bearings, and at the its other end, the drive shaft is supported by an annular projection extending from and integral with the second cup-shaped casing. Additionally, the stator is fixedly secured to the second cup-shaped casing. A gas passage, which allows the outer diameter of the compressor to be reduced, extends through the inner block to provide fluid communication between the first and second chambers.

10 Claims, 4 Drawing Sheets

MOTOR DRIVEN FLUID COMPRESSOR

This application is a continuation of application Ser. No. 07/966,397, filed Oct. 26, 1992, now abandoned.

BACKGROUND OF THE INVENTION

1. Technical Field of the Invention

This invention relates to a fluid compressor, and more particularly to a motor driven fluid compressor having compression and drive mechanisms within a hermetically sealed housing.

2. Description of the Prior Art

Motor driven fluid compressors having compression and drive mechanisms within a hermetically sealed housing are known in the art. For example, as shown in FIG. 1, Japanese Patent Application Publication No. 2-215982 discloses a motor driven fluid compressor 200 having an outer housing 200'. The compression mechanism includes a fixed scroll 201 having first circular end plate 221*a* and first spiral element 221*b* extending downwardly from a lower end surface of first circular end plate 221*a*. Outer peripheral wall 230, extending downwardly from a peripheral portion of one end surface of first circular end plate 221*a*, is connected to first inner block 215. The compression mechanism further includes orbiting scroll 202 disposed between fixed scroll 201 and first inner block 215. Orbiting scroll 202 includes second circular end plate 222*a* and second spiral element 222*b* extending upwardly from an upper end surface of second circular end plate 222*a*. The first and second spiral elements 221*b*, 222*b* interfit with a radial and angular offset.

The drive mechanism includes drive shaft 211 and motor 232 for driving drive shaft 211. Drive shaft 211 includes an integral pin member 234 extending upwardly from a top end thereof. Pin member 234 is drivingly connected to orbiting scroll 202. A rotation preventing mechanism (not shown) is disposed between orbiting scroll 202 and first inner block 215 so that orbiting scroll 202 orbits, but does not rotate, during rotation of drive shaft 211. A lower end surface of second circular end plate 222*a* radially slides on an upper end surface of first inner block 215 during orbital motion of orbiting scroll 202. Second inner block 216, disposed below first inner block 215, includes central bore 236 through which drive shaft 211 passes. An upper end portion of drive shaft 211 is rotatably supported by second inner block 216 by a bearing (not shown) which is disposed within central bore 236. Inlet pipe 203, which is hermetically connected to side wall 238 of housing 200' at a portion below second inner block 216, conducts the refrigerant gas from one external element of a cooling circuit, such as an evaporator (not shown), to inner space 239 of housing 200'.

Valved discharge port 207 is axially formed through a central portion of first circular plate 221*a* of the fixed scroll 201. Outlet pipe 208, which hermetically penetrates through a top end of housing 200', is connected to valved discharge port 207 at its inner end so as to conduct the discharged refrigerant gas to another external element of the cooling circuit, such as a condenser (not shown). Axial channel 214 is formed between one peripheral end of the first and second inner blocks 215 and 216 and inner wall 240 of housing 200'.

While, on the one hand, it is be desirable to reduce the outside diameter of the compressor so that it occupies less space within the engine compartment, this has the incidental effect of reducing the capacity of the compressor, as the outside diameter of the scroll members are also reduced. Therefore, a trade off is typically achieved between maintaining a suitable compression ratio and reducing the outside diameter of the compressor housing. The problem of reducing the outside diameter of a compressor such as that shown in FIG. 1 is complicated because axial channel 214, which supplies refrigerant to the suction side of the compressor, runs along inner wall 240 of housing 200'. Consequently, if the outer diameter of compressor 200 is reduced, axial channel 214 might be choked such that insufficient refrigerant is supplied to the suction side of the compressor.

Moreover, in addition to reducing the outer diameter of the compressor while maintaining its capacity, it is desirable, if a lighter compressor unit is required, to reduce the number of parts. For example, with reference to FIG. 2, there is shown a prior art compressor disclosed in U.S. Pat. No. 4,936,756. As with the compressor of FIG. 1, there is disclosed a motor driven fluid compressor 200''. The compression mechanism includes fixed scroll 201' having first circular end plate 221*a'* and first spiral element 221*b'* extending from an end surface of first circular end plate 221*a'*. The compression mechanism further includes orbiting scroll 202' comprising second circular end plate 222*a'* and second spiral element 222*b'* extending from an end surface of second circular end plate 222*a'*. The first and second spiral elements 221*b'*, 222*b'* interfit with a radial and angular offset.

The drive mechanism includes drive shaft 211' driven by motor 232'. Drive shaft 211' includes an integral pin member 234' extending from an inner end thereof. Pin member 234' is drivingly connected to orbiting scroll 202'. Rotation preventing mechanism 260' is provided so that orbiting scroll 202' orbits, but does not rotate, during rotation of drive shaft 211'. Inlet pipe 203', which is hermetically connected to a side wall 238' of housing 200''', conducts the refrigerant gas from one external element of a cooling circuit, such as an evaporator (not shown), to inner space 239' of housing 200'''.

At one end, drive shaft 211' is supported by inner block 271' through bearings 270', and at its other end, drive shaft 211' is supported by inner block 273' through bearings 272'. Moreover, stator 274' is supported at one end by inner block 271' and at the other end by inner block 273'. In order to reduce the weight of the compressor, the number of parts could be reduced. For example, while it might be desirable to remove inner block 273' from the compressor of FIG. 2, the stator and drive shaft would consequently be cantilevered from the sole remaining inner block 271'. Thus, if parts such as inner block 273' are to be removed from the compressor, the function of the parts so removed must be preformed by the remaining elements of the compressor.

SUMMARY OF THE INVENTION

It is an object of the present invention to reduce the outer diameter of the compressor without reducing the compression ratio or choking the supply of refrigerant to the suction side of the compressor.

Additionally, it is object of the present invention to reduce the number of parts of a hermetically sealed compressor by designing the interior casing of the compressor such that it supports one end of the drive shaft and the stator.

A compressor according to the preferred embodiment includes an outer housing comprising a first cup-shaped casing, a second cup-shaped casing, and a cylindrical portion disposed between the first and second cup-shaped casings. Within the first cup-shaped casing is housed a fixed scroll and an orbiting scroll. The fixed scroll includes an end plate from which a first wrap or spiral element extends into the interior of the housing. The end plate of the fixed scroll divides the housing into a discharge chamber and a suction chamber with the first spiral element being located in the suction chamber. An orbiting scroll includes an end plate from which a second wrap or spiral element extends. The first and second spiral elements interfit at an angular and radial offset to form a plurality of line contacts which define at least one pair of sealed off fluid pockets.

A drive mechanism, which includes a motor supported in the housing, is operatively connected to the orbiting scroll to effect orbital motion thereof. A rotation prevention device prevents the rotation of the orbital scroll during orbital motion so that the volume of the fluid pockets changes to compress the fluid in the pockets inwardly from the outermost pocket towards the central pocket. The compressed gas flows out of the central pocket through a channel in the end plate of the fixed scroll and into a discharge chamber.

The drive mechanism, which is housed in the second cup-shaped casing, includes a drive shaft supported at both ends by bearings. The drive shaft has an axial bore extending along the length thereof and linked to at least one radial bore. One end of the drive shaft includes the open end of the axial bore and is located in close proximity to the inlet of the compressor. The other side of the drive shaft extends into a projecting pin forward of the location where the axial bore terminates within the drive shaft. The terminal end of the axial bore is linked to the projecting pin by an offset channel which opens into a chamber adjacent the end plate of the orbiting scroll. The projecting pin extends through a bushing in this chamber. A further radial bore may be located near the open end of the axial bore of the drive shaft.

An annular inner block extends inwardly from the cylindrical portion and supports the drive shaft through a bearing. The inner block divides the interior of the compressor into a first cavity, which has the drive mechanism therein, and a second cavity, which has the suction side of the compressor therein. The inner block includes at least one gas passage connecting the first and second cavities. Refrigerant fluid introduced into the first cavity flows through the gas passages in the inner block as it approaches the suction chamber of the compressor. Accordingly, by forming gas passages in the inner block, there is no need to provide a separate gas passage disposed radially outside of the motor to supply the suction side of the compressor. Thus, the outer diameter of the compressor can be reduced without choking off the gas flow to the suction side of the compressor.

Additionally, the preferred embodiment includes a support mechanism for the drive shaft and stator which is integrally formed on the compressor housing. In particular, at its rear end, the drive shaft, which in prior art hermetic scroll compressors is supported by an inner block, is supported by an annular cylindrical projection through bearings. Annular cylindrical projection is integrally connected and is essentially an extension of the second cup-shaped portion. Also, the stator, which traditionally is supported at its rear end by the same inner block that supports the drive shaft, is supported by the outer surface of the second cup-shaped casing. Thus, the hermetic scroll compressor according to the preferred embodiment has eliminated the necessity for the inner block traditionally used to support the rear end of the drive shaft and the stator. Accordingly, since a rear inner block is not included, the overall weight of the compressor has been reduced.

Further objects, features and other aspects of this invention will be understand from the detailed description of the preferred embodiments of this invention with reference to the annexed drawings.

DETAILED DESCRIPTION OF THE PREFERRED EMBODIMENTS

Figure 1:
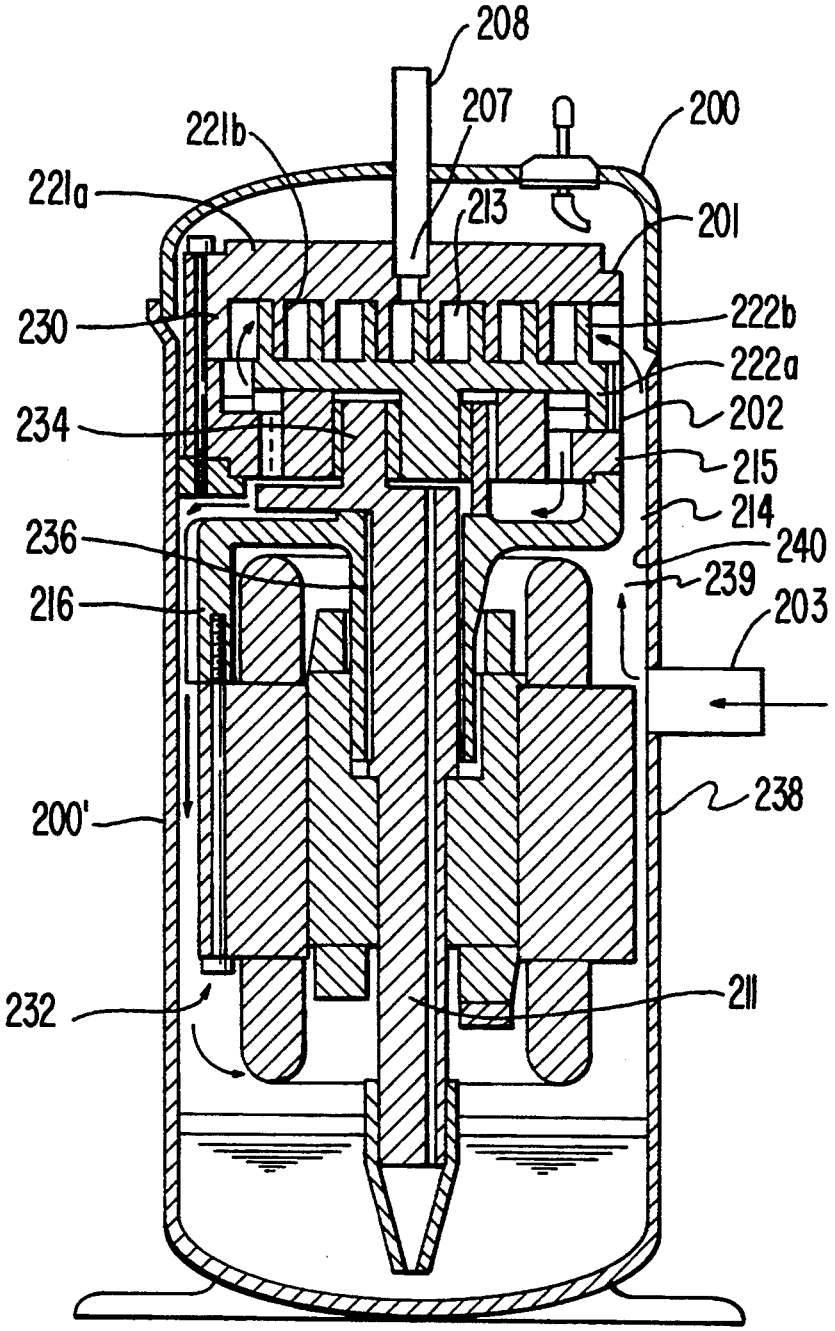
FIG. 1 (PRIOR ART)
FIG. 1 is a longitudinal sectional view of a hermetically sealed scroll type compressor in accordance with the prior art.
Figure 2:
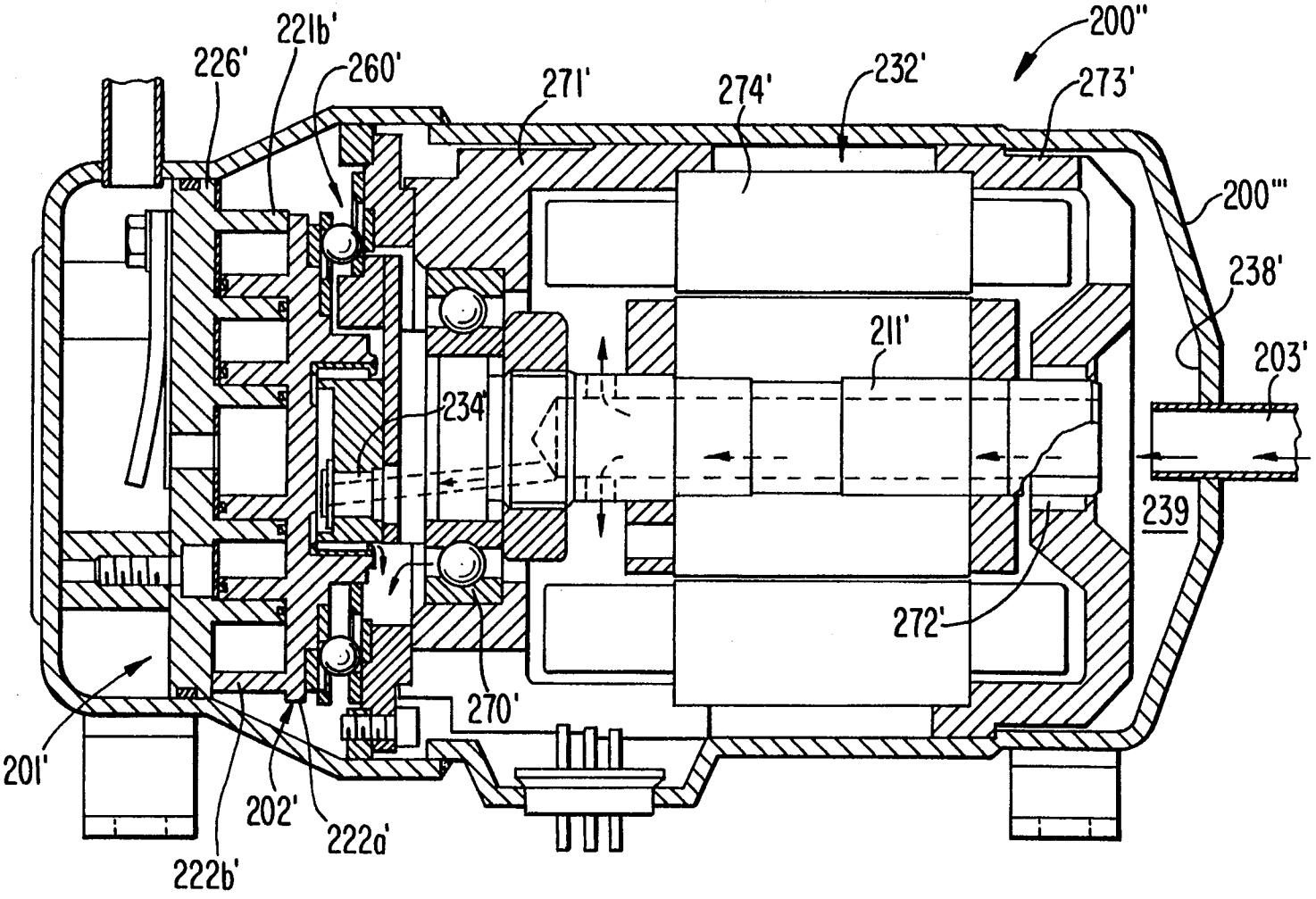
FIG. 2 PRIOR ART
FIG. 2 is a longitudinal sectional view of another hermetically sealed scroll type compressor in accordance with the prior art.
Figure 3:
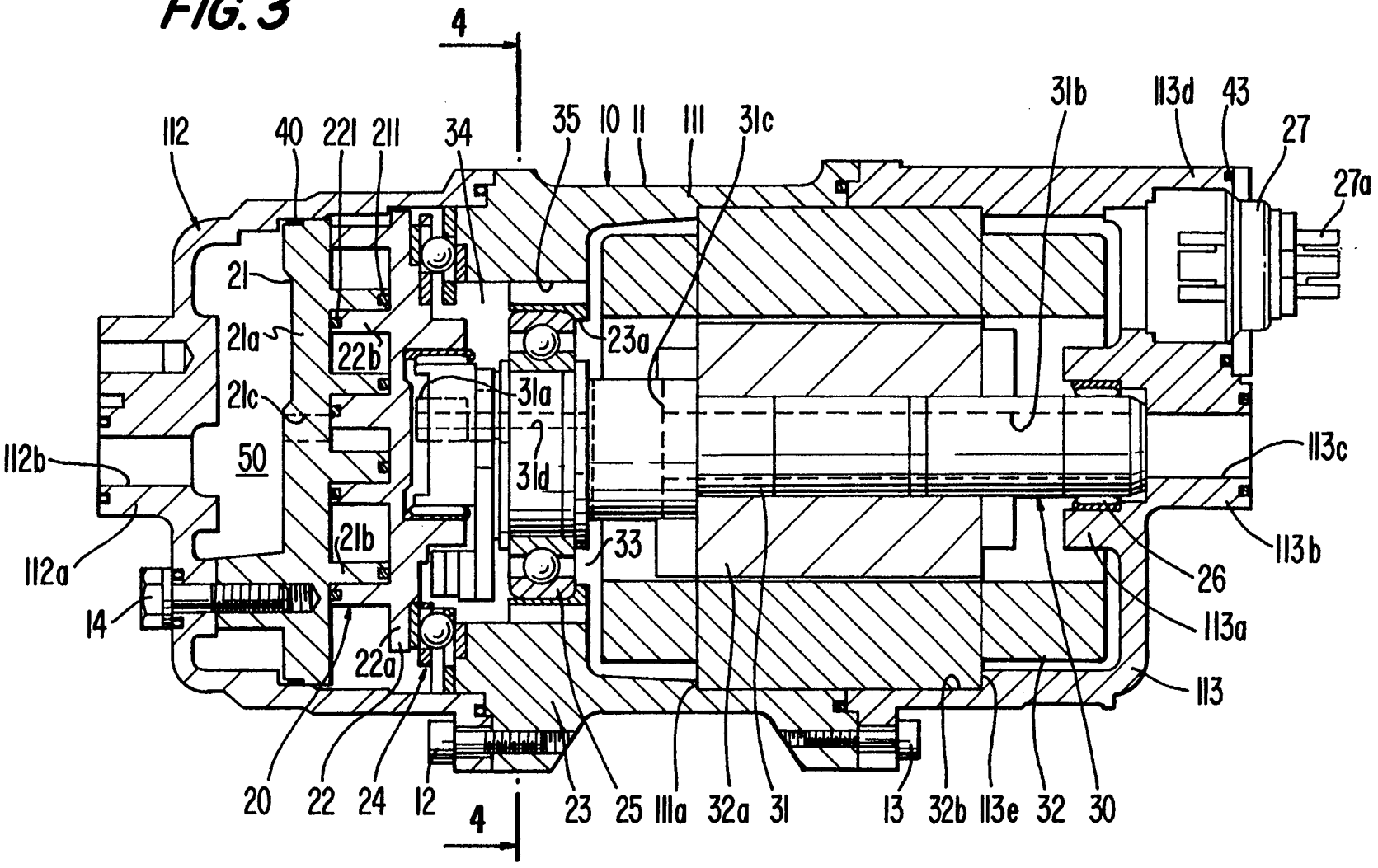
FIG. 3 is a longitudinal sectional view of the motor driven fluid compressor in accordance with a first embodiment of the present invention.

In FIG. 3, for purposes of explanation only, the left side of the figure will be referenced as the forward end or front of the compressor, and the right side of the figure will be referenced as the rearward end or rear of the compressor.

With reference to FIG. 3, an, overall construction of a motor driven fluid compressor, such as a motor driven scroll type fluid compressor 10 in accordance with a first preferred embodiment is shown. Compressor 10 includes compressor housing 11 containing a compression mechanism, such as scroll type fluid compression mechanism 20, and drive mechanism 30 therein. Compressor housing 11 comprises cylindrical portion 111, first cup-shaped portion 112 and second cup-shaped portions 113. An open end of first cup-shaped portion 112 is releasably and hermetically connected to a front open end of cylindrical portion 111 by a plurality of bolts 12. An open end of second cup-shaped portion 113 is releasably and hermetically connected to a rear open end of cylindrical portion 111 by a plurality of bolts 13.

Scroll type fluid compression mechanism 20 includes fixed scroll 21 comprising circular end plate **21*a* and spiral element 21*b* which rearwardly extends from circular end plate 21*a*. Circular end plate 21*a* of fixed scroll 21 is fixedly disposed within first cup-shaped portion 112 by a plurality of bolts 14. Scroll type fluid compression mechanism 20 further includes orbiting scroll 22 comprising circular end plate 22*a* and spiral element 22*b* which extends forwardly from circular end plate 22*a*. Spiral element 21*b* of fixed scroll 21 interfits with spiral element 22*b* of orbiting scroll 22** with an angular and radial offset.

Seal element 211, disposed at an end surface of spiral element **21*b* of fixed scroll 21, seals the mating surfaces between spiral element 21*b* and circular end plate 22*a*. Similarly, seal element 221, disposed at an end surface of spiral element 22*b* of orbiting scroll 22, seals the mating surfaces between spiral element 22*b* and circular end plate 21***a*. O-ring seal element 40, disposed between an outer peripheral surface of circular end plate 21*a* and an inner peripheral surface of first cup-shaped portion 112, seals the mating surfaces therebetween. Discharge chamber 50 is defined by circular end plate 212 of fixed scroll 21 and first cup-shaped portion 112.

Valved discharge port 21*c*, axially formed through circular end plate 21*a*, links discharge chamber 50 to a central fluid pocket (not shown) defined by fixed and orbiting scrolls 21 and 22. First cup-shaped portion 112 includes cylindrical projection 112*a* projecting forwardly from an outer surface thereof. Axial hole 112*b*, which operates as an outlet port of the compressor, is centrally formed through cylindrical projection 112*a*, and is connected to an inlet of another element, such as a condenser (not shown), of an external cooling circuit.

Drive mechanism 30 includes drive shaft 31 and motor 32 surrounding drive shaft 31. Drive shaft 31 includes an integral pin member 31*a* extending from a front end thereof. The axis of pin member 31*a* is radially offset from the axis of drive shaft 31, and pin member 31*a* is drivingly connected to circular end plate 22*a* of orbiting scroll 22. Rotation preventing mechanism 24 ensures that orbiting scroll 22 orbits, but does not rotate, during the rotation of drive shaft 31.

Inner block 23 extends radially inwardly and is integral with the front open end of cylindrical portion 111 of compressor housing 11. On the rearward side of the inner block 23 is first cavity space 33 and in the forward side of inner block 23 is second cavity space 34. Motor drive mechanism 30 is disposed in first cavity 33 while rotation preventing mechanism 24 and fluid compression mechanism 20 are disposed in second cavity 34.

Inner block 23 includes a central hole 23*a* having a longitudinal axis which is concentric with the longitudinal axis of cylindrical portion 111. Bearing 25, which is fixedly disposed within central hole 23*a*, rotatably supports a front end portion of drive shaft 31 through inner block 23. Second cup-shaped portion 113 includes annular cylindrical projection 113*a* projecting forwardly from an inner surface thereof. The longitudinal axis of annular cylindrical projection 113*a* is concentric with the longitudinal axis of second cup-shaped portion 113. Bearing 26, fixedly disposed within annular cylindrical projection 113*a*, rotatably supports a rear end portion of drive shaft 31. Second cup-shaped portion 113 further includes cylindrical projection 113*b* projecting rearwardly from an outer surface thereof.

Axial hole 113*c*, which functions as an inlet port of the compressor, is centrally formed through cylindrical projection 113*b*, and has a diameter which is slightly smaller than an inner diameter of annular cylindrical projection 113*a*. Axial hole 113*c* is in fluid communication with an outlet of another element, such as an evaporator (not shown), of the external cooling circuit through a pipe member (not shown). The longitudinal axis of axial hole 113*c* is concentric with the longitudinal axis of annular cylindrical projection 113*a*.

Drive shaft 31 includes first axial bore 31*b* extending therethrough. One end of first axial bore 31*b* opens at the end surface of drive shaft 31 adjacent axial hole 113*c*. The other end of first axial bore 31*b* terminates at a location which is behind bearing 25. A plurality of radial bores 31*c*, formed at the front terminal end of first axial bore 31*b*, link the front terminal end of first axial bore 31*b* to first cavity 33. Second axial bore 31*d* extends from the front terminal end of first axial bore 31*b*, and opens at a front end surface of pin member 31*a*. The diameter of second axial bore 31*d* is smaller than the diameter of first axial bore 31*b* and the longitudinal axis of second axial bore 31*d* is radially offset from the longitudinal axis of first axial bore 31*b*.

Annular cylindrical projection 113*d* projects rearwardly from and is integral with the outer surface of second cup-shaped portion 113. Hermetic seal base 27 is firmly secured to a rear end of annular cylindrical projection 113*d* by a plurality of bolts (not shown). O-ring seal element 43, disposed at a rear end surface of annular cylindrical projection 113*d*, seals the mating surfaces between hermetic seal base 27 and annular cylindrical projection 113*d*. Wires 27*a* extend from the rear end of stator 32*b*, and pass through hermetic seal base 27 for connection to an external electric power source (not shown).

Motor 32 includes annular-shaped rotor 32*a* surrounding and drivingly connected to an exterior surface of drive shaft 31. An air gap is formed between stator 32*b* and rotor 32*a*. Stator 32*b* is fixedly secured between a first annular ridge 111*a* formed at an inner peripheral surface of cylindrical portion 111 and a second annular ridge 113*e* formed at an inner peripheral surface of second cup-shaped portion 113. The axial length of stator 32*b* is slightly smaller than the axial distance between first annular ridge 111*a* and second annular ridge 113*e*. Accordingly, in assembling the compressor, stator 32*b* is either forcibly inserted into cylindrical portion 111 until it contacts first annular ridge 111*a* or forcibly inserted into second cup-shaped portion 113 until it is in contact with second annular ridge 113*e*.

Figure 4:
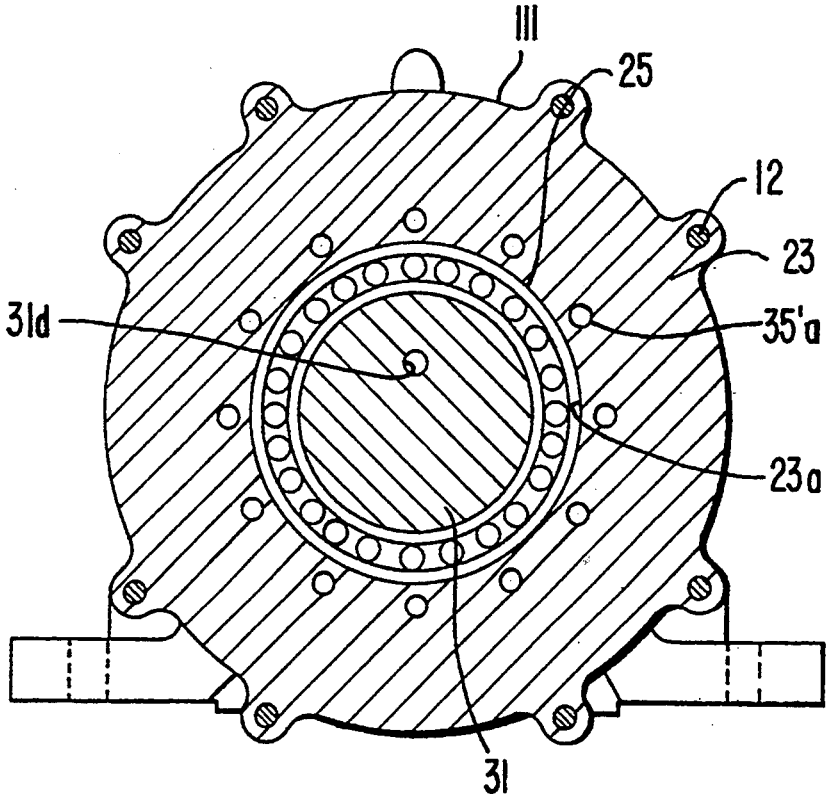
FIG. 4 is a sectional view taken substantially along line 4–4 of FIG. 3.
Figure 5:
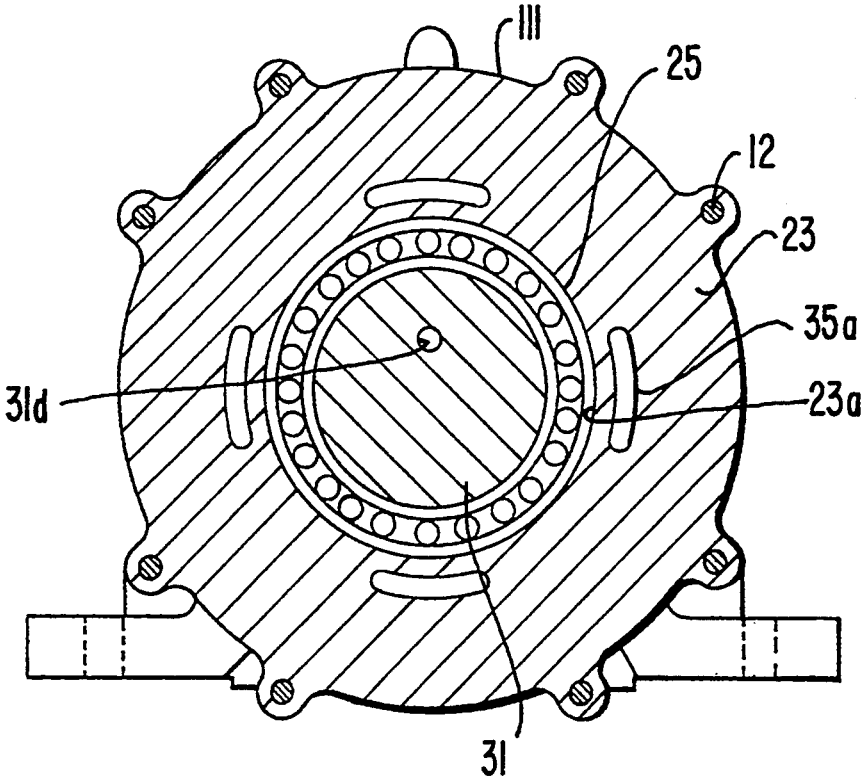
FIG. 5 is a view similar to FIG. 4, illustrating a second embodiment of the present invention.

Gas passage 35, as shown in FIG. 4, includes a plurality of circular holes 35*a* formed through inner block 23 outside of bearing 25. For example, gas passageway 35 can include eight equiangularly spaced circular gas flow passages 35*a*. Alternatively, as shown in FIG. 5, gas passageway 35 includes a plurality of oval holes 35*a* formed through inner block 23 outside of bearing 25. For example, gas passageway can include four equiangularly spaced oval gas flow passages.

The gas channels 35*a*, 35*a*', which provide a fluid communication path between first cavity 33 and second cavity 34, allows the outer diameter of the compressor to be reduced without choking off the fluid path leading to the suction side of the compression mechanism 20. In addition, there is no need for a separate passage running along the inside surface of the compressor housing, since passageways 35*a*, 35*a*' link first cavity 33 to second cavity 34 from the interior of the compressor.

In operation, refrigerant gas from axial hole 113*c* enters axial bore 31*b*, flows out radial bores 31*c*, and then flows through gas passage 35 which connects first cavity 33 with second cavity 34. After flowing through second cavity 34, the refrigerant flows through the rotation preventing mechanism 24 and into the outer sealed fluid pockets between fixed scroll 21 and orbiting scroll 22. Once in the outer sealed fluid pockets, the refrigerant gas undergoes a resultant volume reduction and compression and is moved towards the central fluid pocket. Finally, the compressed refrigerant gas is discharged to outlet port 112*b* through discharge chamber 50 and discharge port 21*c*.

Moreover, the number of parts and weight of the compressor have been reduced. In particular, since the rear of drive shaft 31 is supported by annular cylindrical projection 113*a*, and since the rear of stator 32*b* is supported by second cup-shaped portion 113, the rear inner block, which was necessary to support these elements in prior art compressors, has been eliminated. Therefore, a lighter and more compact compressor is obtained.

While this invention has been described in connection with the preferred embodiments, these embodiments are merely intended to provide an exemplary description of the invention and are not intended to restrict the invention thereto. It will be understood by those skilled in the art that other variations and modifications can easily be made within the scope of the invention as defined by the appended claims.

We claim:

1. A motor driven hermetic fluid compressor with a hermetically sealed housing, said compressor housing including a first cup-shaped portion, a second cup-shaped portion, and a cylindrical portion disposed between said first and second cup-shaped portions, said compressor further comprising:

an inner block extending from said cylindrical portion and dividing said compressor housing into a first cavity and a second cavity;

a compressing mechanism disposed in said second cavity for compressing a gaseous fluid, said compressor comprising:

an inlet;

a fixed scroll having an end plate from which a first spiral wrap extends; and an orbiting scroll having an end plate from which a second spiral wrap extends, said first and second wraps interfitting at an angular and radial offset to form a plurality of line contacts which define at least one pair of sealed off fluid pockets;

a driving mechanism disposed in said first cavity for driving said compressing mechanism, said driving mechanism comprising:

a drive shaft drivingly connected to said compressing mechanism, said drive shaft having a bore extending therethrough for conducting said gaseous fluid to said inlet of said compressing mechanism;

a rotor drivingly connected to said drive shaft for transferring rotational power to said drive shaft; and a stator disposed outside of said rotor, said stator and rotor spaced by an air gap therebetween;

supporting means, integrally connected to said housing, for fixedly securing said stator within said first cavity;

said inner block rotatably supporting an inner end portion of said drive shaft through a bearing, said bearing disposed in a central hole in said inner block and forming a first flow passage through said inner block, said inner block dividing an inner space of said housing into a first inner space in which said driving mechanism is disposed and a second inner space in which said compressing mechanism is disposed; and a second flow passage formed through said inner block.

2. The motor driven hermetic fluid compressor of claim 1, said second flow passage comprising a plurality of flow passages formed through said inner block.

3. The motor driven hermetic fluid compressor of claim 2, said plurality of flow passages spaced equiangularly around said inner block.

4. The motor driven hermetic fluid compressor of claim 3, wherein said inner block has eight flow passages.

5. The motor driven hermetic fluid compressor of claim 3, said plurality of flow passages comprising circular flow passages.

6. The motor driven hermetic fluid compressor of claim 3, wherein said inner block has four flow passages.

7. The motor driven hermetic fluid compressor of claim 3, said plurality of flow passages comprising oval flow passages.

8. The motor driven hermetic fluid compressor of claim 1, further comprising a second supporting means, integrally connected to and extending from one axial end of said housing, for rotatably supporting one end of said drive shaft, said second supporting means comprising an annular cylindrical projection extending from an inner surface of said housing, said annular surface having a bearing disposed therein.

9. The hermetic type scroll compressor of claim 1, said supporting means comprising a first annular ridge formed in said cylindrical portion and a second annular ridge formed in said second cup-shaped casing.

10. The hermetic scroll type compressor of claim 9, said stator sandwiched between said first and second annular ridges.

* * * * *